US010660409B2

(12) United States Patent
Caldwell et al.

(10) Patent No.: US 10,660,409 B2
(45) Date of Patent: May 26, 2020

(54) TOE PORTION FOR A SPRINT SHOE

(71) Applicant: NIKE, Inc., Beaverton, OR (US)

(72) Inventors: Cailee M. Caldwell, Beaverton, OR (US); Ingrid Hagen-Keith, Portland, OR (US); Austin Orand, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 42 days.

(21) Appl. No.: 15/923,759

(22) Filed: Mar. 16, 2018

(65) Prior Publication Data

US 2018/0263341 A1 Sep. 20, 2018

Related U.S. Application Data

(60) Provisional application No. 62/472,944, filed on Mar. 17, 2017.

(51) Int. Cl.

| | |
|---|---|
| ***A43B 5/06*** | (2006.01) |
| ***A43C 15/00*** | (2006.01) |
| ***A43B 23/08*** | (2006.01) |
| ***A43B 13/16*** | (2006.01) |
| ***A43B 13/26*** | (2006.01) |
| ***A43B 5/02*** | (2006.01) |

(52) U.S. Cl.

CPC ..... *A43C 15/00* (2013.01); *A43B 5/02* (2013.01); *A43B 5/06* (2013.01); *A43B 13/16* (2013.01); *A43B 13/26* (2013.01); *A43B 23/08* (2013.01); *A43B 23/087* (2013.01)

(58) Field of Classification Search

CPC ..... A43B 5/06; A43B 23/081; A43B 23/08; A43B 13/22; A43B 13/26; A43C 15/00

USPC ..... 36/77 R, 72 R, 129, 134, 130

See application file for complete search history.

(56) References Cited

U.S. PATENT DOCUMENTS 2,864,180 A * 12/1958 Montgomery ..... A43B 5/18 36/126
4,378,643 A * 4/1983 Johnson ..... A43B 13/223 36/129
4,439,936 A * 4/1984 Clarke ..... A43B 5/06 36/102

(Continued)

FOREIGN PATENT DOCUMENTS

EP 2976959 A1 1/2016
WO WO 1998/020763 A1 5/1998

OTHER PUBLICATIONS

International Search Report and Written Opinion mailed in International Application No. PCT/US2018/022953, dated Jul. 20, 2018 (11 pages).

(Continued)

*Primary Examiner* — Marie D Bays
(74) *Attorney, Agent, or Firm* — Klarquist Sparkman, LLP

(57) ABSTRACT

A track and field shoe can include an upper, a sole structure, and a toe plate. The upper can include a medial side portion, a lateral side portion, and a toe box portion. The sole structure can be attached to the upper and can include a spike plate. The spike plate can have an anterior portion and a posterior portion. The toe plate can be attached to an anterior portion of the toe box portion of the upper and can include a hard and smooth outwardly facing surface. One or more portions of the toe plate can be exposed from an exterior surface of the upper.

7 Claims, 8 Drawing Sheets

(56) References Cited

U.S. PATENT DOCUMENTS 4,658,514 A * 4/1987 Shin ..... A43B 5/06 36/30 R
5,410,821 A * 5/1995 Hilgendorf ..... A43B 1/0081 36/100
5,775,010 A * 7/1998 Kaneko ..... A43B 13/26 36/129
5,829,172 A * 11/1998 Kaneko ..... A43B 5/06 36/108
6,061,931 A * 5/2000 Kaneko ..... A43B 1/0009 36/129
6,243,973 B1 * 6/2001 Lind ..... A43B 13/26 36/100
6,311,415 B1 * 11/2001 Lind ..... A43B 5/00 36/130
7,152,340 B2 * 12/2006 Issler ..... A43B 1/0081 36/15
10,251,444 B2 * 4/2019 Corbett ..... A43B 5/005
2001/0039745 A1 11/2001 Nakano et al.
2007/0068043 A1 * 3/2007 Clark ..... A43B 7/125 36/72 R
2008/0034617 A1 * 2/2008 Anderson ..... A43B 5/1633 36/116
2010/0293816 A1 * 11/2010 Truelsen ..... A43B 5/06 36/30 R
2012/0167419 A1 * 7/2012 Park ..... A43B 7/26 36/77 R
2014/0259784 A1 * 9/2014 Jenkins ..... A43B 13/181 36/102
2015/0089842 A1 4/2015 Zamer-Juarez et al.
2015/0181974 A1 * 7/2015 Davis ..... A43B 5/06 36/91
2016/0120266 A1 * 5/2016 Huang ..... A43C 15/161 36/66

OTHER PUBLICATIONS

Adidas, Neptune XS Men's Cross Country Shoes, downloaded from https://www.amazon.co.uk/ADIDAS-Neptune-Country-Silver-Yellow/dp/B004S3E9AW, 3 pp. (accessed Jun. 25, 2018).
Mizuno, 9-Spike Advanced Mizuno Pro Elite, downloaded from https://www.mizunousa.com/product/baseball-9-spike-mizuno-pro-elite.do, 1 p. (accessed Jun. 25, 2018).

* cited by examiner

TOE PORTION FOR A SPRINT SHOE

CROSS REFERENCE TO RELATED APPLICATION

This application claims the benefit of U.S. Provisional Application No. 62/472,944, filed Mar. 17, 2017, which application is incorporated by reference herein in its entirety.

FIELD

This disclosure generally relates to articles of footwear and more particularly to articles of footwear for short distance track and field events.

BACKGROUND

A sprint shoe for short distance track and field events, such as the 100 m, 200 m, and 400 m races, typically comprises a spike plate and an upper. The spike plate includes traction elements (e.g., spikes) configured to increase friction between the sprint shoe and a track surface so that a sprinter does not slip during the event. The upper is formed from a thin, soft, flexible material configured to conform tightly to the sprinter's foot. Both the upper and the spike plate are configured to be as light as possible, even at the expense of durability. As such, a sprinter may use sprint shoe for only a few races before they discard it and replace it with a new sprint shoe.

DETAILED DESCRIPTION

Figure 1:
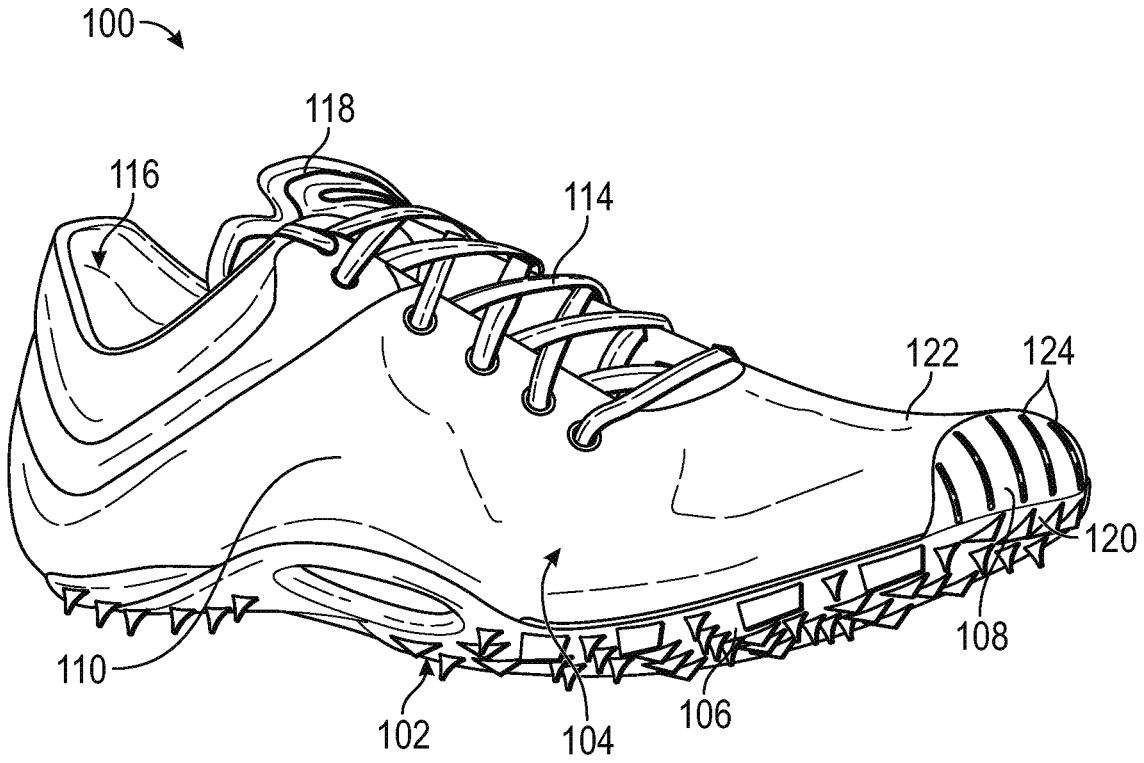
FIG. 1 shows a side perspective view of an exemplary embodiment of an article of footwear.

For purposes of this description, certain aspects, advantages, and novel features of the embodiments of this disclosure are described herein. The described methods, systems, and apparatus should not be construed as limiting in any way. Features, characteristics, and/or groups described in conjunction with a particular aspect, embodiment or example are to be understood to be applicable to any other aspect, embodiment or example described herein unless incompatible therewith. All of the features disclosed in this specification (including any accompanying claims, abstract, and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract, and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

The explanations of terms and abbreviations herein are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

As used herein, the term "and/or" used between the last two of a list of elements means any one of, or any combination of, the listed elements. For example, the phrase "A, B, and/or C" means "A," "B," "C," "A and B," "A and C," "B and C," or "A, B, and C."

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the term "approximately" means the listed value and any value that is within 10% of the listed value. For example, "approximately 50%" means any value between 45-55%, inclusive.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

In short distance track and field events such as the 100 m, 200 m, and 400 m races, a sprinter typically starts a race from a crouched position with their feet positioned on a starting block and their hands on the ground. As the race begins, the sprinter accelerates by pushing off of the starting block with their legs and gradually transitions from the crouched position to an upright running position. Keeping the body low through the first several steps of a race may provide several benefits. For example, the sprinter's feet stay low to the ground, which may reduce the distance the feet need to travel to the next step. A low position may also create power and drive the hips down the track, thus setting up a pattern to create maximum horizontal velocity.

Figure 5:
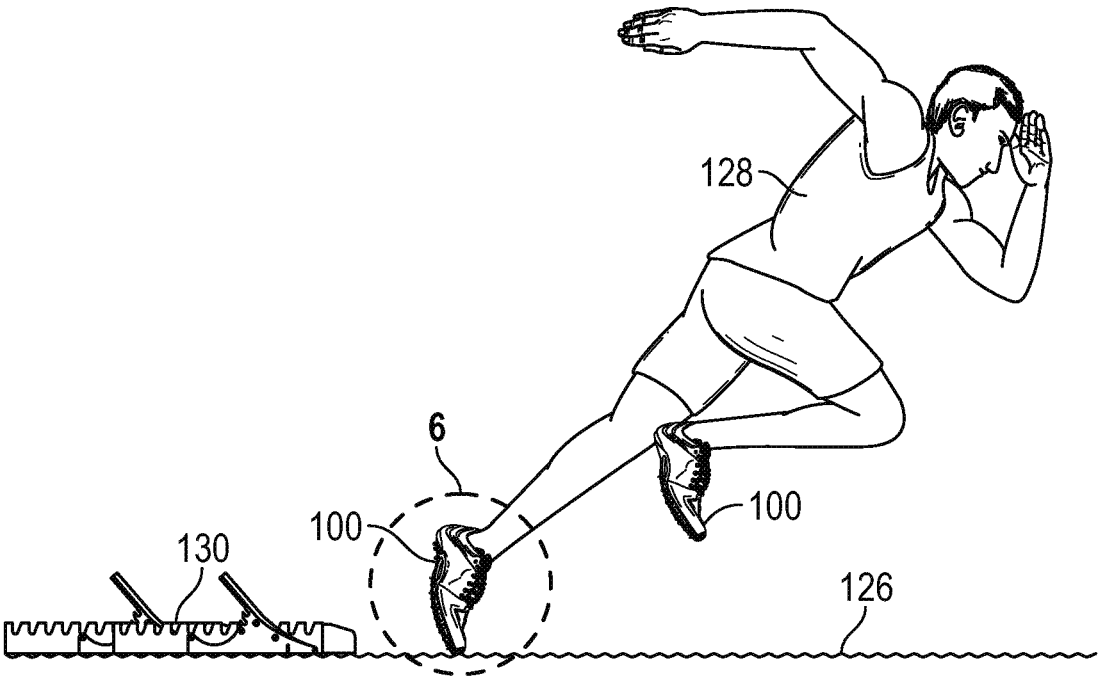
FIG. 5 shows the article of FIG. 1 in use by a sprinter.
Figure 6:
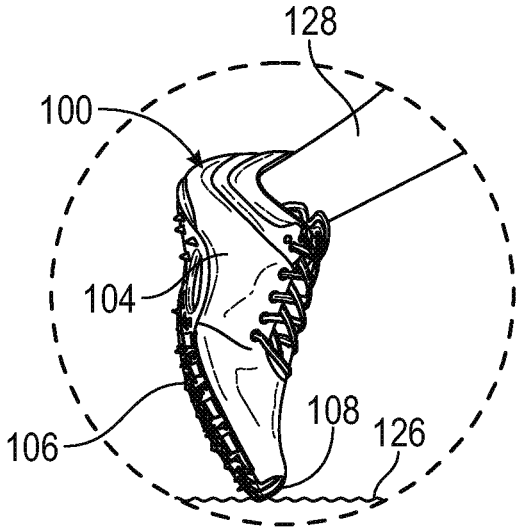
FIG. 6 shows a detail view of FIG. 5.

As part of keeping their body low, some sprinters drag their toe during one or more of the first few steps of the race, as shown for example in FIGS. 5-6. However, the "toe-drag technique" (as it is sometimes called) has several disadvantages. For example, friction between sprinter's shoe and the track surface may decrease the sprinter's acceleration. It may also cause the sprinter's toe to "chatter" or "skip" along the track surface, thus disrupting the sprinter's stride. These drawbacks may increase the sprinter's race time in races that are typically decided by fractions of a second.

Described herein are embodiments of articles of footwear (also referred to herein as "articles" or "shoes") that may reduce friction between the sprinter's shoes and the track surface during toe-drag. Accordingly, the articles described herein may improve acceleration and decrease race times.

The articles of footwear described herein can be used for various track and field events such as the 100 m, 200 m, and 400 m races, the 60 m, 100/110 m, and 400 m hurdles, long jump, high jump, and any other event in which the athlete sprints and/or the upper of the shoe drags on the track surface.

In one representative embodiment, a track and field shoe comprises an upper, a sole structure, and a toe plate. The upper includes a medial side portion, a lateral side portion, and a toe box portion. The soles structure is attached to the upper and includes a spike plate. The spike plate has an anterior portion and a posterior portion. The toe plate is attached to an anterior portion of the toe box portion of the upper. One or more portions of the toe plate are exposed from an exterior surface of the upper.

In some embodiments, the toe plate comprises a first frictional property relative to a surface, the upper comprises a second frictional property relative to the surface, and the first frictional property of the toe plate is less than the second frictional property of the upper.

In some embodiments, the first frictional property of the toe plate is a first coefficient of kinetic friction relative to the surface, the second frictional property of the upper is a second coefficient of kinetic friction relative to the surface, and the first coefficient of kinetic friction is less than the second coefficient of kinetic friction.

In some embodiments, the spike plate comprises a third frictional property relative to the surface, and wherein the first frictional property of the toe plate is less than the third frictional property of the spike plate.

In some embodiments, the first frictional property of the toe plate is a first coefficient of kinetic friction relative to the surface, the second frictional property of the upper is a second coefficient of kinetic friction relative to the surface, wherein the third frictional property of the spike plate is a third coefficient of kinetic friction, and the first coefficient of kinetic friction is less than the second coefficient of kinetic friction and less than the third coefficient of kinetic friction.

In some embodiments, the first coefficient of kinetic friction of the toe plate is less than 0.75, and the second coefficient of kinetic friction of the upper is greater than or equal to 0.75.

In some embodiments, one or more portions of the toe plate comprises a hardness of greater than 65 measured on a type D Shore durometer scale.

In some embodiments, the toe plate comprises one or more of nylon, PEBA, PTFE, HDPE, POM, TPU, and UHMWPE.

In some embodiments, the toe plate comprises a height measured from a superior edge of the toe plate to an inferior edge of the toe plate, and the height is within a range of 5 mm to 100 mm.

In some embodiments, the toe plate comprises a first width measured at a midpoint of the height of the toe plate, the spike plate comprises a second width measured at a widest part of the spike plate, and the first width of the toe plate is less than 75 percent of the second width of the spike plate.

In some embodiments, the toe plate is attached to the spike plate.

In some embodiments, the toe plate is spaced apart from the spike plate.

In some embodiments, the toe plate comprises a convex exterior curvature.

In some embodiments, the shoe is a first shoe in a pair of shoes, and the pair of shoes further comprises a second shoe, wherein the second shoe does not include a toe plate.

In another representative embodiment, a track and field shoe comprises an upper, and a sole structure. The upper includes a medial side portion, a lateral side portion, and a toe box portion. The sole structure is attached to the upper and includes a spike plate. The spike plate has an anterior portion, a posterior portion, and a toe plate extending in a superior direction and a posterior direction from the anterior portion of the spike plate. One or more portions of the toe plate extend over an exterior surface of the toe box portion of the upper.

In some embodiments, the spike plate and the toe plate are integrally formed as a single piece.

In some embodiments, the toe plate comprises at least one raised surface.

In some embodiments, the raised surface comprises an elongate rail.

In some embodiments, the rail includes a longitudinal axis that is angled relative to a superior/inferior axis of the article.

In some embodiments, the angle between the longitudinal axis of the rail and the superior/inferior axis of the article is within a range of 5 degrees to 45 degrees.

In some embodiments, the toe plate comprises a plurality of outwardly extending raised surfaces, and the raised surfaces are spaced apart relative to each other.

In some embodiments, the raised surfaces include respective longitudinal axes that are parallel to a superior/inferior axis of the article.

In some embodiments, the raised surfaces include respective longitudinal axes that are non-parallel to a superior/inferior axis of the article.

In some embodiments, the raised surfaces comprise first and second ends, wherein the first ends of the raised surfaces are disposed relatively closer to the medial side portion of the upper than the respective second ends of the raised surfaces.

In some embodiments, the first ends of the raised surfaces are disposed farther in the posterior direction from the anterior portion spike plate than the second ends of the raised surfaces.

In some embodiments, the toe plate is attached to the toe box portion of the upper.

In another representative embodiment, a track and field shoe comprises an upper and a sole structure. The upper includes a medial side portion, a lateral side portion, and a toe box portion. The sole structure is attached to the upper and includes a spike plate. The spike plate has an anterior portion, a posterior portion, and a toe plate. The toe plate extends in a superior direction and a posterior direction from the anterior portion of the spike plate and includes a plurality of raised surfaces.

In some embodiments, either or both of the toe plate and the raised surfaces comprise a hardness of 70-90 measured on a type D Shore durometer scale.

In some embodiments, either or both of the toe plate and the raised surfaces comprise a coefficient of kinetic friction of 0.1-0.6 relative to a surface.

In some embodiments, the spike plate, toe plate, and the raised surfaces are integrally formed as a unitary component.

In some embodiments, the toe plate is attached to the toe box portion of the upper.

In another representative embodiment, a track and field shoe comprises an upper and a sole structure. The upper includes a medial side portion, a lateral side portion, and a toe box portion. The sole structure is attached to the upper and includes a spike plate. The spike plate has an anterior portion, a posterior portion, and a plurality of rails. The rails extend in a superior direction from the anterior portion of the spike plate.

In some embodiments, the rails are spaced relative to each other, and the toe box portion of the upper is exposed between the rails.

In some embodiments, the rails extend in a posterior direction from the anterior portion of the spike plate.

In another representative embodiment, a track and field shoe comprises an upper, a sole structure, and a plurality of rails. The upper includes a medial side portion, a lateral side portion, and a toe box portion. The sole structure is attached to the upper and includes a spike plate. The spike plate has an anterior portion and a posterior portion. The rails are attached to the toe box portion of the upper.

In some embodiments, the rails comprise a first frictional property relative to a surface, the upper comprises a second frictional property relative to the surface, and the first frictional property of the rails is less than the second frictional property of the upper.

In some embodiments, the first frictional property of the rails is a first coefficient of kinetic friction relative to the surface, the second frictional property of the upper is a second coefficient of kinetic friction relative to the surface, and the first coefficient of kinetic friction is less than the second coefficient of kinetic friction.

In some embodiments, the spike plate comprises a third frictional property relative to the surface, and the first frictional property of the rails is less than the third frictional property of the spike plate.

FIGS. 1-6 illustrate an exemplary embodiment of an article of footwear ("article") 100 and its components. Although in certain figures a single article is shown for purposes of clarity, it should be noted that embodiments may include corresponding first and second articles of footwear 100 (e.g., FIGS. 5-6) configured for a left and right foot, respectively. Thus, it will be understood that the principles discussed herein may equally apply to another article of footwear corresponding to article of footwear 100.

FIG. 1 shows an exemplary article footwear 100 comprising a sole structure 102 and an upper 104 that is attached to the sole structure 102. The sole structure 102 can comprise a spike plate 106 with a toe plate 108. The upper 104 can comprise a medial portion 110, a lateral portion 112 (FIG. 2), a closure system 114, and an opening 116. As shown in the illustrated embodiment, the closure system 114 can be coupled to and disposed between the medial and lateral portions 110, 112 (e.g., over a tongue portion 118 of the article 100). The closure system 114 can be configured to allow the opening 116 to expand to allow a wearer's foot to be inserted into the article 100 and to constrict to secure the wearer's foot within the article 100.

The spike plate 106 of the sole structure 102 can be coupled to a bottom portion of the upper 104, for example, with adhesive and/or stitching. The spike plate 106 can comprise a plurality of molded and/or metal spikes. In certain embodiments, one or more of the spikes can be integrally formed with the spike plate 106. In other embodiments, one or more of the spikes can be removably attached to the spike plate 106.

Figure 3:
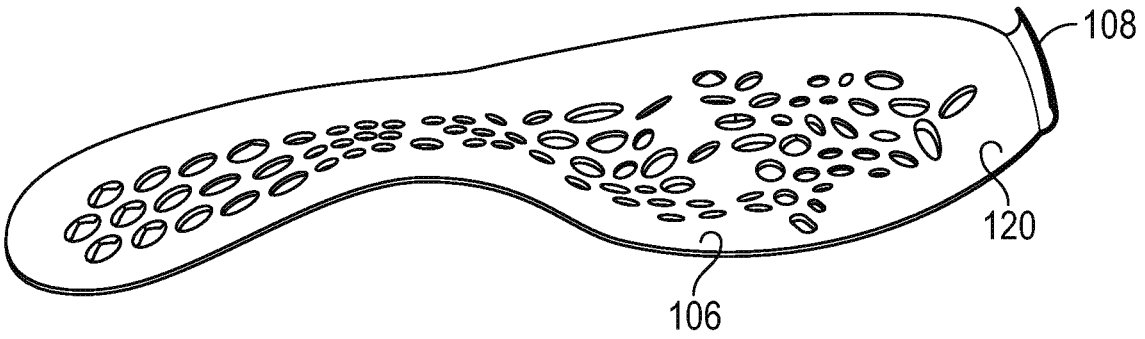
FIGS. 3-4 show side perspective views of a spike plate of the article of FIG. 1.
Figure 4:
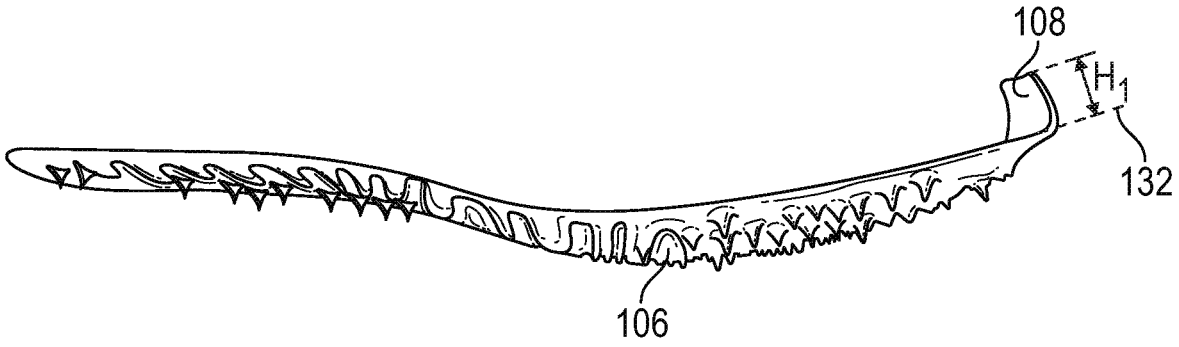

The toe plate 108 of the sole structure 102 can extend in a superior direction (e.g., vertically) from an anterior portion 120 of the spike plate 106 and can be attached to a toe box portion 122 of the upper 104. In some embodiments, the toe plate 108 can be integrally formed with the spike plate 106, as best shown in FIGS. 3-4. For example, the toe plate 108 and the spike plate 106 can be co-molded (e.g., injection molded). In other embodiments, the toe plate 108 and spike plate 106 can be formed as separate pieces. If formed as separate pieces, the toe plate 108 and spike plate 106 and can be coupled together (e.g., with adhesive, fasteners, or other means for coupling) and secured to the article 100 together, or they can be individually coupled to the sole structure 102 and the toe box portion 122 of the upper 104, respectively. The toe plate 108 can be attached to the toe box portion 122 of the upper 104, for example, with adhesive and/or stitching.

Figure 2:
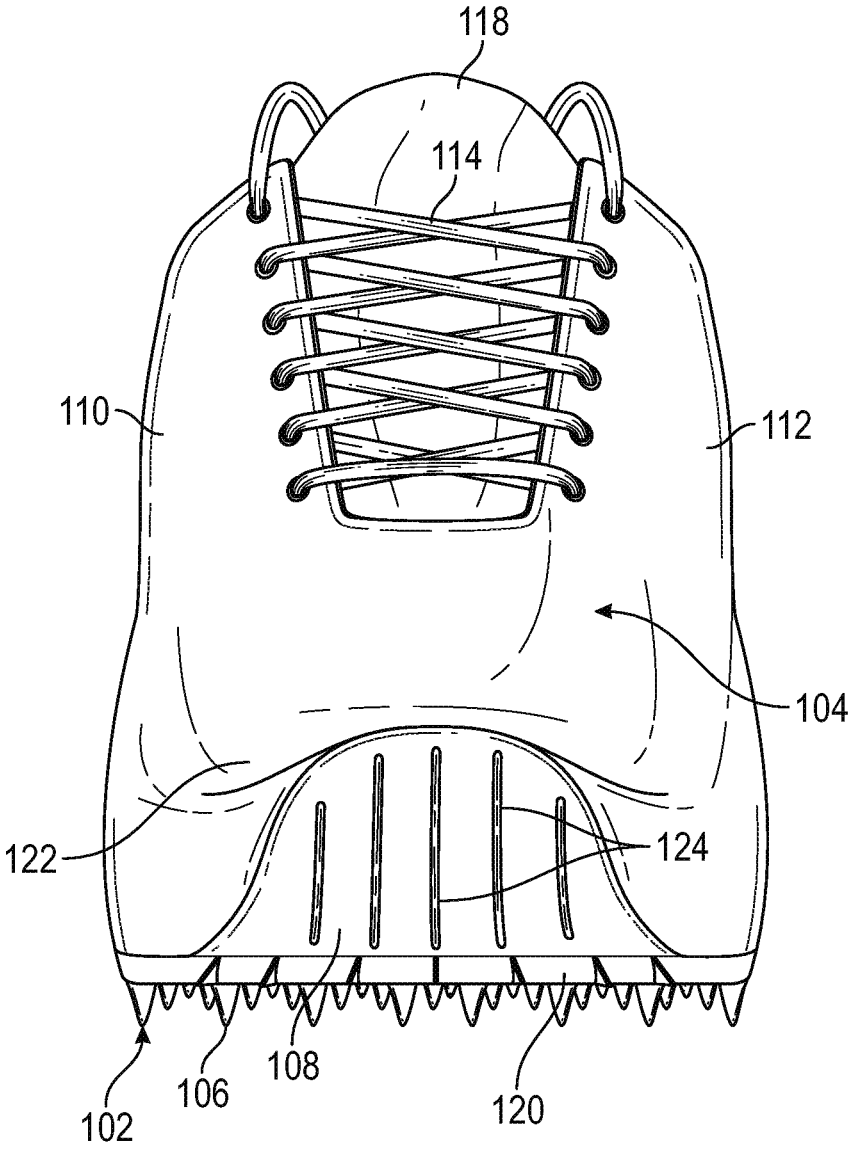
FIG. 2 shows a front elevation view of the article of FIG. 1.

Referring to FIG. 2, in certain embodiments, the toe plate 108 can optionally comprise one or more raised surfaces 124 that extend outwardly from a portion of the toe plate 108. For example, in the illustrated embodiment, the toe plate comprises five raised surfaces 124. In some embodiments, the toe plate 108 can have fewer or more than five raised surfaces 124. For example, the toe plate 108 can have one relatively wider raised surface 124, or multiple relatively narrower raised surfaces 124. The raised surfaces 124 can be configured to extend outwardly from the toe plate 108 such that only the raised surfaces 124 contact the track surface during toe-drag. The raised surfaces 124 may therefore further reduce drag by reducing the surface area of the toe plate 100 that contacts the track surface.

The raised surfaces 124 can comprise various configurations and/or shapes. For example, in some embodiments, the raised surfaces 124 can include elongate surfaces (i.e., surfaces that are longer than they are wide) such as rails, ribs, and/or ridges. The elongate surfaces can comprise various cross-sectional profiles (e.g., rectangular, circular, ovular, triangular, etc.) taken in a plane perpendicular to longitudinal axes of the elongate surfaces. In other embodiments, the raised surfaces can comprise a plurality of projections such as nubs and/or bumps.

In some embodiments, the toe plate 108 and the raised surfaces 124 can be integrally formed (e.g., co-molded). In other embodiments, the raised surfaces 124 can be formed separately from the toe plate 108 and attached to the toe plate 108.

Despite conventional wisdom to form the upper from soft, flexible material and to minimize the weight of a sprinting shoe, configuring the article 100 with a hard, smooth toe plate 108 and/or raised surfaces 124 attached to the upper 104 can provide several advantages. For example, the hard, smooth toe plate 108 and/or raised surfaces 124 (rather than the relatively soft, rough upper 104) can contact a track surface 126 when a sprinter 128 toe-drags out of a starting block 130, as best shown in FIGS. 5-6. Due to the low friction between the toe plate 108 and/or the raised surfaces 124 and the track surface 126, the article 100 moves forward quickly and smoothly without chattering or skipping. As a result, even with the added weight, the toe plate 108 and/or the raised surfaces 124 may increase a sprinter's acceleration and thus may reduce the sprinter's times.

Figure 7:
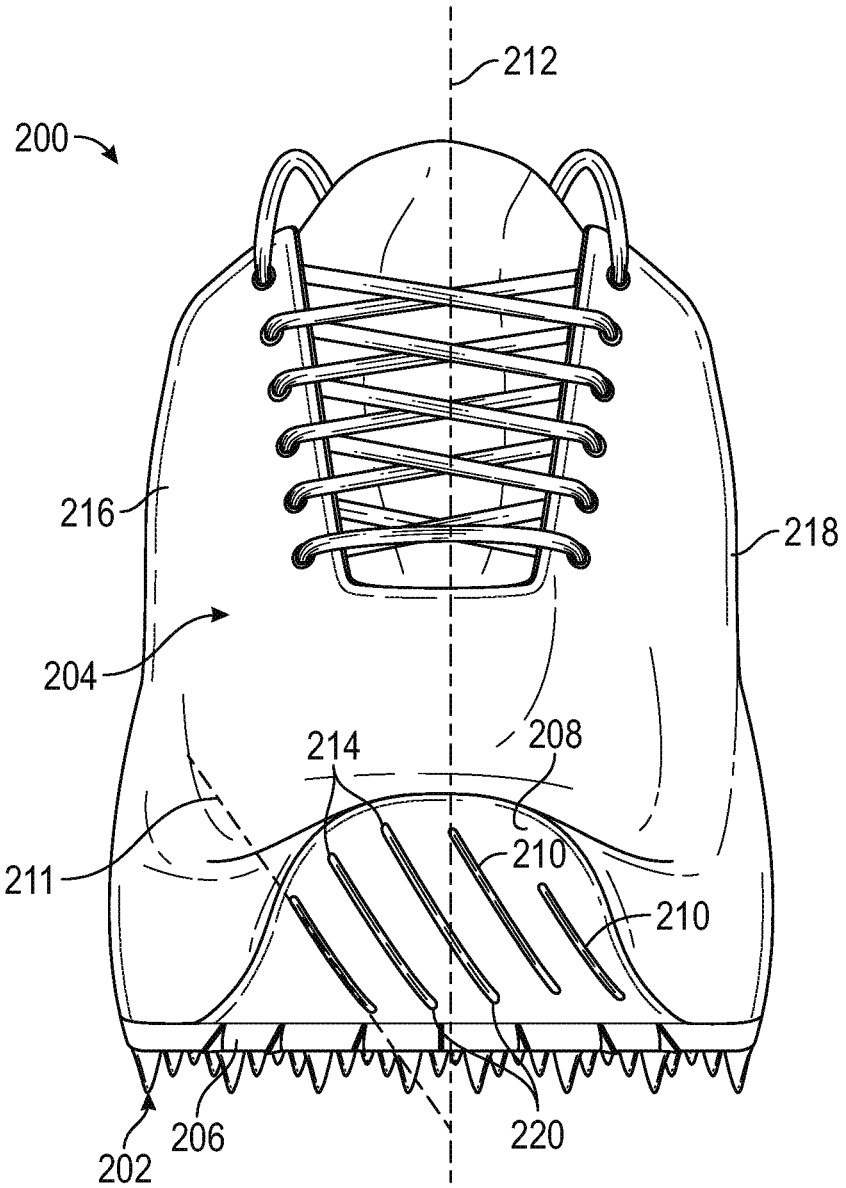
FIG. 7 shows a front elevation view of an article of footwear, according to another embodiment.

FIG. 7 shows an exemplary article of footwear 200 comprising a sole structure 202 and an upper 204 attached to the sole structure 202. The sole structure 202 can comprise a spike plate 206 with a toe plate 208. The article 200 can generally be configured substantially similar to the article 100.

The toe plate 208 can comprise one or more outwardly extending raised surfaces 210. The raised surfaces 210 can comprises longitudinal axes (e.g., axis 211). The raised surfaces 210 can be configured such that the longitudinal axes of the raised surfaces 210 are angled (e.g., non-parallel) to a superior/inferior axis 212 of the article 200. The angle and/or direction in which the raised surfaces 210 extend can be configured to correspond to an angle at which the sprinter drags their toe relative to the track surface so that the raised surfaces 210 are parallel to the horizontal direction of travel of the sprinter's toe. This may reduce friction between the raised surfaces 210 and the track surface and may prevent or reduce toe chatter, which may promote quick and smooth toe-drag.

In some embodiments, the angle between the longitudinal axes of the raised surfaces 210 and the superior/inferior axis 212 of the article 200 is greater than approximately 0 degrees and less than approximately 90 degrees or within a range of 5 degrees to 45 degrees, inclusive. In certain embodiments, the angle can be with a range of approximately 10-20 degrees, inclusive.

In some embodiments, the raised surfaces 210 can be configured such that first ends 214 of the raised surfaces 210 are disposed relatively closer to either a medial side 216 or a lateral side 218 of the upper 204 than respective second ends 220 of the raised surfaces 210. For example, in the illustrated embodiment, the first ends 214 of the raised surfaces 210 are disposed relatively closer to the medial side 216 of the upper 204 than respective second ends 220 of the raised surfaces 210. In some embodiments, a pair of shoes can be configured such that the first ends 214 of the raised surfaces 210 of each shoe in the pair are disposed relatively closer to the medial side 216 of the upper 204 than the respective second ends 220 of the raised surfaces 210. In other words, the right and left shoes can be mirrored relative to each other.

Some sprinters may drag the toe of one foot at a different angle and/or direction relative to the track surface than the sprinter drags the toe of the other foot relative to the track surface. As such, in some embodiments, the raised surfaces 210 of one toe (e.g., the right article) can be configured at a different angle and/or direction (toward the medial or lateral side) than the raised surfaces 210 of the other toe (e.g., the left article).

Figure 8:
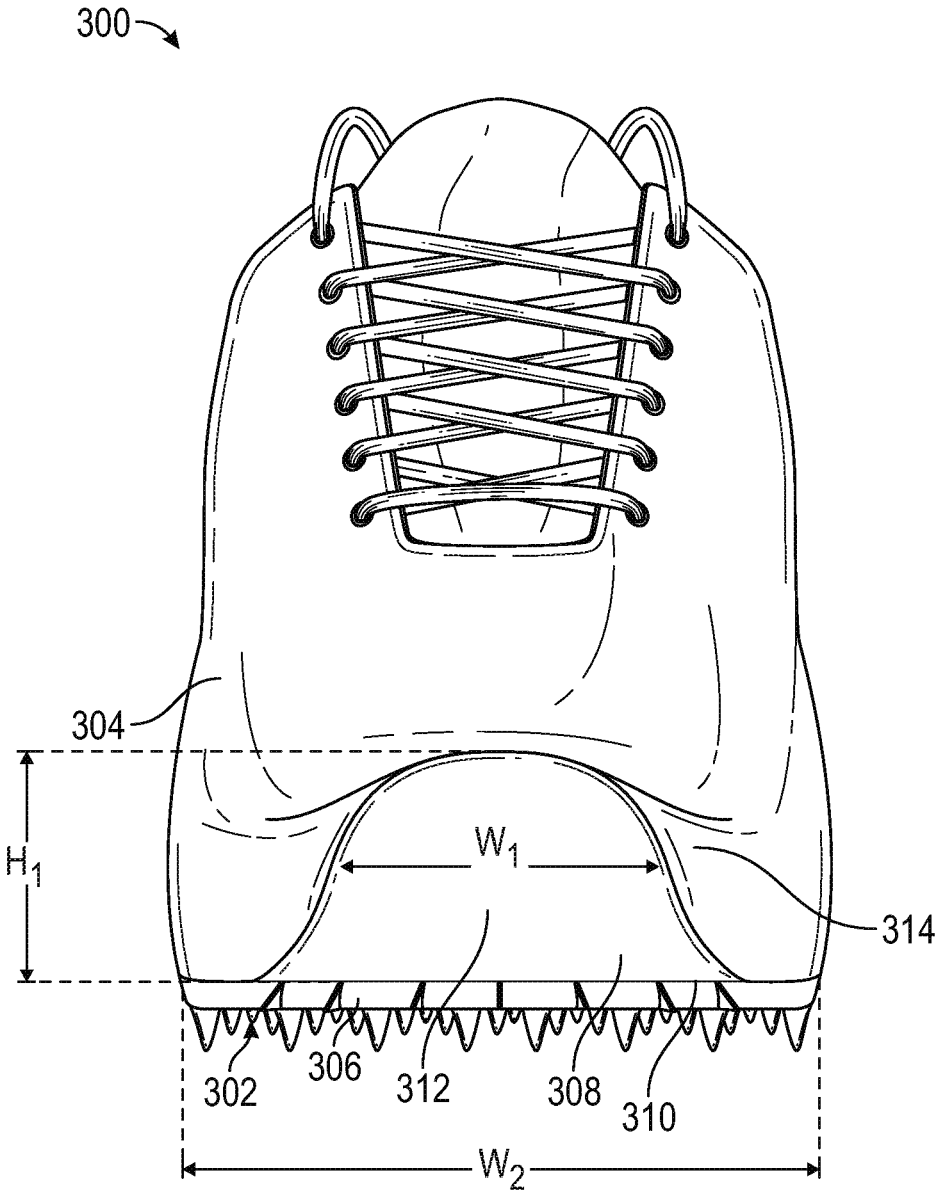
FIG. 8 shows a front elevation view of an article of footwear, according to another embodiment.

FIG. 8 shows an exemplary article of footwear 300. The article 300 can comprise a sole structure 302 and an upper 304 attached to the sole structure 302 and can generally be configured substantially similar to the article 100. The sole structure 302 can comprise a spike plate 306.

The article 300 can further include a toe plate 308 that extends in a superior direction from an anterior portion 310 of the spike plate 306 and over a toe box portion 312 of the upper 304. As shown, the toe plate 308 can comprise a hard, smooth outwardly facing surface 312.

In some embodiments, the toe plate 308 can be coupled (e.g., co-molded or with an adhesive) to an anterior portion 310 of the spike plate 306. In certain embodiments, the toe plate 308 and the spike plate 306 can be co-molded from the same material. In other embodiments, the toe plate 308 and the spike plate 306 can be co-molded from different materials. This can be accomplished, for example, by using a two-step molding process in which the spike plate 306 is formed during a first step and the toe plate 308 is formed during a second step.

In some embodiments, the toe plate 308 and the spike plate 306 can be separately formed. In certain embodiments, the toe plate 308 can coupled (e.g., stitched and/or with an adhesive) to a toe box portion 314 of the upper 304. In such embodiments, the toe plate 308 can be formed from a first material (e.g., PTFE) and the spike plate can be formed from a second material (e.g., nylon).

In some embodiments, the toe plate 308 can be coupled to the upper 304 in various manners. For example, in certain embodiments, the toe plate 308 can be 3-D printed onto the toe box portion 312 of the upper 304.

The toe plate 308 can comprise various shapes and/or configurations. For example, the toe plate 308 can comprise a generally trapezoidal shape, as shown in the illustrated embodiment. In other embodiments, the toe plate 308 can comprise various other shapes such as triangular, rectangular, and/or ovular. In some embodiments, the toe plate 308 can configured to follow a convex exterior curvature of the toe box portion 314 (e.g., the curvature of the anterior end of the toe box portion). For example, the toe plate 308 can have a convex exterior curvature.

Referring still to FIG. 8, the toe plate 308 can comprise a height $H_1$ and a width $W_1$. The height $H_1$ of the toe plate can be measured from a superior edge of the toe plate to an inferior edge of the toe plate. In embodiments that the toe plate and the spike plate are formed as a single piece, the inferior edge of the toe plate can be defined by a line extending from a superior surface of the spike plate (see, e.g., line 132 shown in FIG. 4). The width $W_1$ of the toe plate can be measured at a midpoint of the height $H_1$ (i.e., at a location $H_1/2$). The spike plate 306 can comprise a width $W_2$ measured at the widest part of the spike plate 306. In some embodiments, the width $W_1$ of the toe plate can be less than approximately 75%, less than approximately 50%, less than approximately 25%, or less than approximately 15% of the width W2 of the spike plate 306. In some embodiments, the height $H_1$ can be within a range of approximately 5 mm to 100 mm (which includes 5 mm and 100 mm) or a range of approximately 10 mm to 30 mm (which includes 10 mm and 30 mm).

Figure 9:
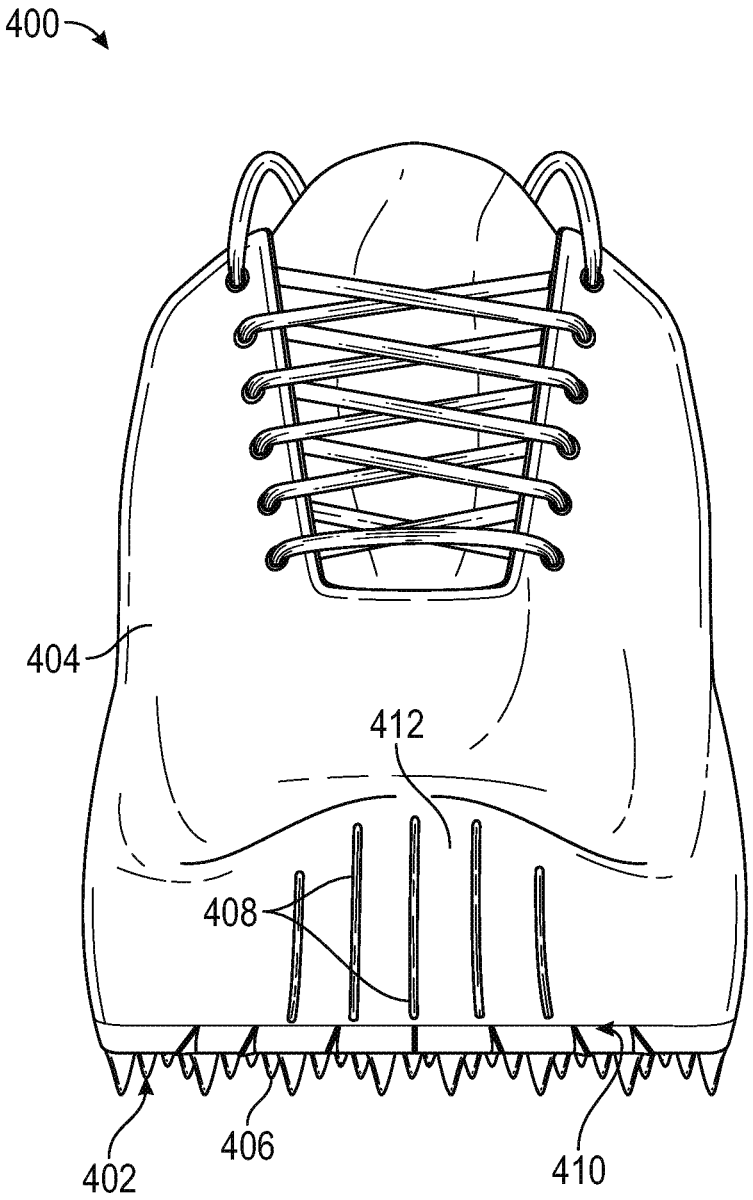
FIG. 9 shows a front elevation view of an article of footwear, according to another embodiment.
Figure 10:
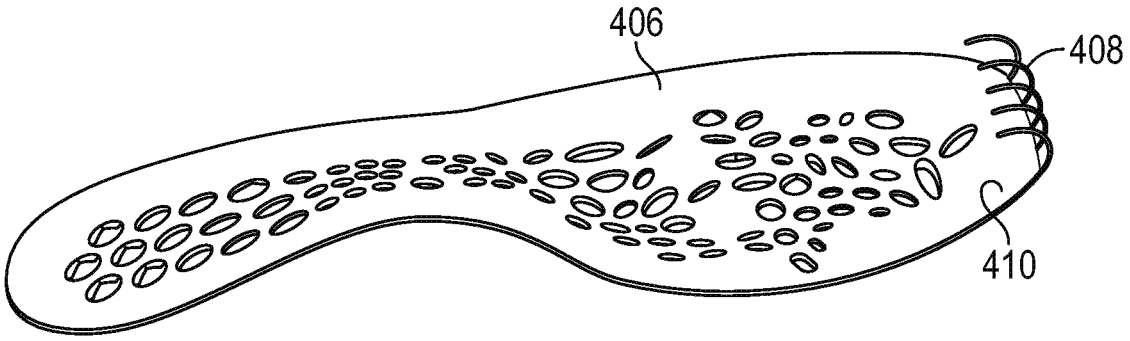
FIG. 10 shows a side perspective view of a spike plate of the article of FIG. 9.

FIGS. 9-10 show an exemplary article of footwear 400 and its components. Referring to FIG. 9, the article 400 can comprise a sole structure 402 and an upper 404 attached to the sole structure 402 and can generally be configured substantially similar to the article 100.

As best shown in FIG. 10, the sole structure 402 can comprise a spike plate 406 and a plurality of raised surfaces 408 that extend in a superior direction (e.g., upwardly) from or adjacent an anterior portion 410 of the spike plate 406 and can extend in a posterior direction (e.g., toward the heel portion) over a toe box portion 412 of the upper 404. The raised surfaces 408 can be provided in lieu of (as opposed to in addition to) a toe plate (e.g., the toe plate 308) to reduce weight. The raised surfaces 408 (e.g., rails) can be spaced relative to each other such that the toe box portion 412 of the upper 404 is exposed between the raised surfaces 408, as shown in FIG. 9.

In some embodiments, the raised surfaces 408 can be coupled (e.g., co-molded or with an adhesive) to an anterior portion 410 of the spike plate 406. In lieu of or in addition to being coupled to the spike plate 406, in some embodiments, the raised surfaces 408 can be coupled (e.g., with stitching and/or with an adhesive) to the toe box portion 412 of the upper 404. For example, in certain embodiments, the raised surfaces 408 can be 3-D printed onto the toe box portion 412 of the upper 404.

Some sprinters may toe-drag during only one step (e.g., the first step) out of the starting block. Accordingly, in some embodiments, only one article in pair (e.g., the right article) can comprise a toe plate (e.g., toe plates 108, 208, 308) and/or raised surfaces (e.g., raised surfaces 124, 210, 408), and the other article in the pair (e.g., the left article) can be configured without a toe plate and/or raised surfaces. This may help to reduce friction during toe-drag while reducing the overall weight of the pair.

The disclosed toe plates and/or raised surfaces can be formed from material that is relatively hard and smooth. For example, the toe plates and/or raised surfaces can be formed from material comprising a hardness of greater than approximately 65, or in certain embodiments between approximately 70-90, measured on a type D Shore durometer scale. In certain embodiments, the toe plates and/or raised surfaces can comprise one or more of nylon, polyether block amide ("PEBA"), polytetrafluoroethylene ("PTFE"), high-density polyethylene ("HDPE"), polyoxymethylene ("POM"), thermoplastic polyurethane ("TPU"), and ultra-high molecular weight polyethylene ("UHMWPE").

The disclosed toe plates and/or raised surfaces can have one or more first frictional properties that are less than one or more second frictional properties of other portions of the article such as the upper. The first and second frictional properties can include a coefficient of static friction ("$\mu_s$"), a coefficient of kinetic friction ("$\mu_k$"), and/or other metric for measuring friction. For example, in some embodiments, the toe plate and/or raised surface of the article can have a $\mu_k$ of less than approximately 0.75 (or in certain embodiments 0.1-0.6) relative to a surface (e.g., a track surface), and the upper of the article can have a $\mu_k$ that is greater than or equal to 0.75 (or in certain embodiments 0.9-1.2) relative to the surface. The first frictional properties of the toe plate and/or raised surface and the second frictional properties of the upper should be compared relative to the same surface, with the same normal force, and at the same temperature, velocity, atmospheric pressure, humidity, and/or other property that may affect the measurement of frictional properties.

For example, in one particular embodiment, the $\mu_k$ of the toe plate and/or raised surfaces and a track surface (e.g., track surface 126 shown in FIGS. 5-6) is approximately 0.65. For comparison, in some embodiments, the $\mu_k$ between an upper (e.g., uppers, 104, 204, 304, 404) and the track surface is approximately 0.9-1.2.

Exemplary track surfaces can include one or more of synthetic materials, grass, turf, dirt, gravel, rock (e.g., packed granite), asphalt, concrete, and/or other material used for track surfaces. Synthetic track surfaces can include one or more of polyurethane, rubber, etc. Rubber for synthetic track surfaces can include one or more of ethylene propylene diene monomer ("EPDM"), styrene-butadiene rubber ("SBR"), latex, natural rubber, and/or a polymeric material. Rubber can also include virgin or recycled materials (e.g., shredded tires).

In certain embodiments, the toe plates and/or raised surfaces can have a smooth surface finish to reduce friction relative to the track surface. For example, the toe plates and/or raised surfaces can be polished, buffed, and/or have a lubricious coating to create a smooth surface finish.

In some embodiments, the toe plate, raised surfaces, and/or spike plate can be formed from the same material (e.g., nylon, PEBA, PTFE, HDPE, POM, TPU, and/or UHMWPE). In other embodiments, the toe plate, raised surfaces, and/or the spike plate can be formed from different materials. For example, in one particular embodiment, the toe plate can be formed from nylon and the raised surfaces can be formed from HDPE, or vice versa. In another particular embodiment, the spike plate can be formed from PEBA and the toe plate can be formed from PTFE.

Configuring an article of footwear with a toe plate and/or raised surfaces as described herein may, in certain embodiments, reduce friction during a sprinter's toe-drag by approximately 40% or more relative to conventional track shoes. This, in turn, may reduce horizontal forces by approximately 50% or more. It may also reduce vertical forces because the sprinter's foot does not chatter or skip along the track surface, which may reduce total horizontal forces (friction+horizontal components of the vertical forces) by approximately 80% or more. Ultimately, the reduced forces may advantageously help the sprinter get to the next step up to, or exceeding, approximately 0.5-1.0% faster.

The contemplated embodiments likewise include structural features described herein with regard to any example, can be combined with other structural features described in any one or more of the other examples. For example, the width ratios and/or heights of the toe plate 308 described with respect to the article 300 can be combined with the angled raised surfaces 210 described with respect to the article 200.

In view of the many possible embodiments to which the principles of the disclosure may be applied, it should be recognized that the illustrated embodiments are only examples and should not be taken as limiting the scope of the disclosure. Rather, the scope of the claimed subject matter is defined by the following claims and their equivalents.

The invention claimed is:

1. A track and field shoe, comprising:

an upper including a medial side portion, a lateral side portion, and a toe box portion; and a sole structure attached to the upper and including a spike plate, wherein the spike plate has an anterior portion, a posterior portion, a plurality of spikes, and a toe plate extending in a superior direction and a posterior direction from the anterior portion of the spike plate, wherein the spikes extend in an inferior direction from the anterior portion of the spike plate and are configured for penetrating a track surface, and wherein one or more portions of the toe plate comprise a plurality of elongate rails extending over an exterior surface of the toe box portion of the upper, and wherein the rails comprise longitudinal axes that extend in a superior/inferior direction.

2. The shoe of claim 1, wherein the spike plate and the toe plate are integrally formed as a single piece.

3. The shoe of claim 1, wherein the longitudinal axes of the rails are angled relative to a superior/inferior axis of the shoe.

4. The shoe of claim 3, wherein the angle between the longitudinal axes of the rails and the superior/inferior axis of the shoe is within a range of 5 degrees to 45 degrees.

5. A track and field shoe, comprising:

an upper including a medial side portion, a lateral side portion, and a toe box portion; and a sole structure attached to the upper and including a spike plate and a toe plate, wherein the spike plate has an anterior portion, a posterior portion, a plurality of spikes, and wherein the spikes extend in an inferior direction from the anterior portion of the spike plate and are configured for penetrating a track surface, and wherein the toe plate is integrally formed with the spike plate as a single piece, and wherein the toe plate is void of the spikes such that the spikes do not engage the track surface when the toe plate drags along the track surface.

6. The shoe of claim 5, wherein the toe plate comprises a raised surface having a longitudinal axis that extends parallel to a superior/inferior axis of the shoe.

7. The shoe of claim 5, wherein the toe plate comprises a raised surface having a first end and a second end, wherein the first end of the raised surface is disposed closer to the medial side portion of the upper than the second end of the raised surface, and wherein the second end of the raised surface is disposed adjacent to the spike plate.

* * * * *